US007036340B1

(12) United States Patent
Chen

(10) Patent No.: US 7,036,340 B1
(45) Date of Patent: May 2, 2006

(54) HEAT DISSIPATING SYSTEM OF HIGH-SPEED CIRCULAR KNITTING MACHINE

(75) Inventor: Shih-Lung Chen, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/218,462

(22) Filed: Sep. 6, 2005

(51) Int. Cl.
*D04B 35/30* (2006.01)

(52) U.S. Cl. ..... 66/8; 66/168

(58) Field of Classification Search ..... 66/8, 66/168, 1 R, 7, 79, 114
See application file for complete search history.

(56) References Cited

U.S. PATENT DOCUMENTS 3,173,273 A * 3/1965 Fulton ..... 62/5
3,654,768 A * 4/1972 Inglis et al. ..... 62/5
4,644,621 A * 2/1987 Yates et al. ..... 28/247
5,737,942 A 4/1998 Gutschmit
6,199,408 B1 3/2001 Shibata
6,401,463 B1 * 6/2002 Dukhan et al. ..... 62/5
6,750,668 B1 * 6/2004 Johnson ..... 324/760

* cited by examiner

*Primary Examiner*—Danny Worrell
(74) *Attorney, Agent, or Firm*—Birch, Stewart, Kolasch & Birch, LLP

(57) ABSTRACT

A heat dissipating system of a high-speed circular knitting machine includes a super low temperature air gun. Cold air is ejected from a cold air outlet of the super low temperature air gun for carrying away the high heat produced by a cylinder base during a knitting process. The super low temperature air gun is connected to an extension pipe and extended to a gap between a cutting disc and a pressing plate, or saddle bases, or a lower rhombus ring and two saddle bases, or yarn feeding nozzles. Cold air ejected from the cold air outlet passes through the gap to the cylinder base or other peripheral components of the high-speed circular knitting machine to achieve the heat dissipating effect. The super low temperature air gun is installed inside a leg for supporting a yarn supplying device or on its external surface or on a yarn feeding ring.

8 Claims, 7 Drawing Sheets

HEAT DISSIPATING SYSTEM OF HIGH-SPEED CIRCULAR KNITTING MACHINE

FIELD OF THE INVENTION

The present invention relates to a heat dissipating system of a high-speed circular knitting machine, and more particularly to a heat dissipating system capable of effectively lowering the high heat produced by a circular knitting machine during a knitting process.

BACKGROUND OF THE INVENTION

In general, a circular knitting machine is composed of three sections which are a yarn supply section, a knitting section, and a cloth rolling section. The cylinder of the knitting section rotates about the center of the circular knitting machine, and a knitting needle is installed in a groove of the cylinder base and guided by a track of a cam to -displace up and down while the cylinder base is rotating. When the knitting needle displaces up and down in the groove of the cylinder base, the sinker is pushed out timely to carry out the knitting with the knitting needle. It is worth to note that the knitting needle will constantly rub with the groove of the cylinder base to produce a high heat of up to 90 degrees Centigrade during the knitting process. The high heat will affect the movement among components due to the thermal expansion, and also may cause a breaking of yarns and produce defective products since the yarns cannot bear the high heat.

In view of the foregoing shortcomings of the prior art, manufacturers design a heat dissipating device on the circular knitting machine (particularly at the cylinder base) to eliminate the high heat so produced. U.S. Pat. No. 5,737,942 entitled "Means for deterring lint and debris accumulation on the knitting element of a circular knitting machine" comprises a curved plate disposed between a horizontal frame plate and a circular frame plate to define an air chamber, an air pump for sending compressed air to the air chamber through an air supply hose, and the compressed air flows to the cylinder base and other peripheral components so as to achieve the effects of removing dusts and dissipating heat. U.S. Pat. No. 6,199,408 entitled "Cooling apparatus for knitting components" comprises a cover disposed between an intermediate ring and a lower ring to form a cylindrical chamber between a needle-selecting actuator and the cover, and a ventilation fan installed on the cover for guiding external air into the chamber and passing the air through an opening of the chamber for cooling the heat produced by the cylinder base and its peripheral components.

However, the foregoing heat dissipating device use the air at room temperature for dissipating the heat, and thus it can only reduce the high temperature produced by the friction between the knitting needle and the groove of the cylinder base to 80 degrees Centigrade, and the heat dissipating effect is very limited. Therefore, current manufacturers spare no efforts to overcome the shortcoming of the prior art whose heat dissipating effect is poor.

SUMMARY OF THE INVENTION

The primary objective of the present invention is to provide a heat dissipating system of a high-speed circular knitting machine that supply a low-temperature gas to the cylinder base and its peripheral components during a knitting process for effectively lowering the high temperature produced by the cylinder base and its peripheral components, so as to maximize the heat dissipating effect.

To achieve the foregoing objective, the present invention provides a heat dissipating system of a high-speed circular knitting machine comprised of a super low temperature air gun, and the super low temperature air gun including an air inlet, a cold air outlet, a swirl generating chamber, a brake, and a hot air discharge outlet, wherein the air inlet, cold air outlet, and swirl generating chamber are installed at an end of the super low temperature air gun, and the brake and the hot air discharge outlet are installed at the other end of the super low temperature air gun. Compressed air is passed into the air inlet and undergone a rapid cooling process by the super low temperature air gun, and then ejected from the cold air outlet. The present invention mainly installs a super low temperature cold air gun onto the circular knitting machine, and ejects cold air from the cold air outlet through the super low temperature air gun to effective carry away the high heat produced at the cylinder base of the circular knitting machine through a knitting process.

The technical contents of the present invention will now be described in more detail hereinafter with reference to the accompanying drawings that show various embodiments of the invention.

DETAILED DESCRIPTION OF THE PREFERRED EMBODIMENTS

Figure 1:
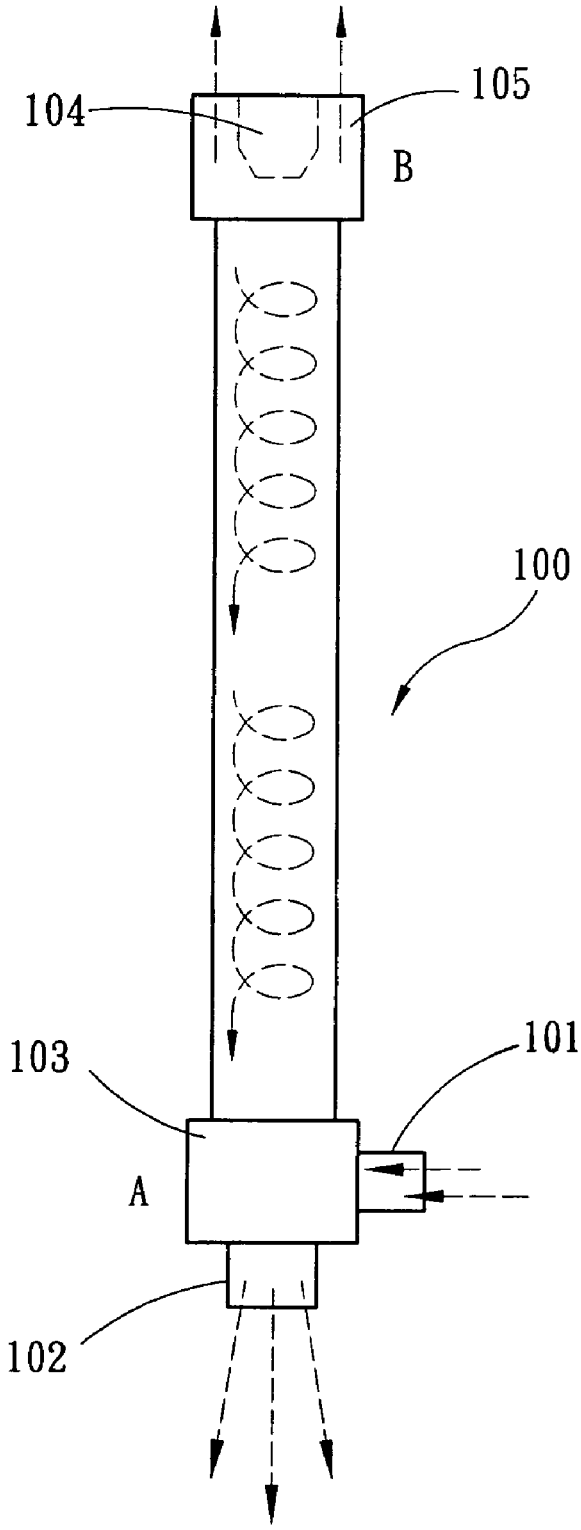
FIG. 1 is a schematic view of a heat dissipating system of a high-speed circular knitting machine of the present invention.

Refer to FIG. 1 for a heat dissipating system of a high-speed circular knitting machine in accordance with the present invention. The invention provides a super low temperature air gun 100 that requires no refrigerant or power, which is used extensively in the areas of cooling knives during the cutting and drilling metals, rapid cooling for soldering electronic components, and cooling plastic formation. The inventor of the present invention installs the super low temperature air gun 100 on the circular knitting machine 10 (as shown in the following figures) and aims a cold air outlet 102 of the super low temperature air gun 100 at the high-speed rotary cylindrical base 11 (which is a position of a high heat source produced in the knitting process) and blows cold air at the cylindrical base 11 of the circular knitting machine 10 to effectively lower the high heat of the cylinder base 11 and its peripheral components.

The structure and the cooling principle of the super low temperature air gun 100 are described as follows. In FIG. 1, the super low temperature air gun 100 comprises an air inlet 101, the cold air outlet 102, a swirl generating chamber 103, a brake 104 and a hot air discharge outlet 105, wherein the air inlet 101, cold air outlet 102 and swirl generating chamber 103 are installed at one end of the super low temperature air gun 100, and the brake 104 and hot air discharge outlet 105 are installed at the other end of the super low temperature air gun 100. When compressed air (supplied by an air compressor) flows from the air inlet 101 into the external side of the swirl generating chamber 103 and ejects along the tangential direction with a sound-speed expansion, which will produce a high-speed swirl flowing from A to B. Since the centrifugal force produced by the swirl increases the pressure and density at the external side of the swirl and decreases the pressure and density at the internal side of the swirl, therefore the internal side of the swirl will release energy towards the external side of the swirl. If the high-speed swirl reaches the bottom of the pipe, the swirl will be vanished by the blocking of the brake 104. Therefore, the kinetic energy of the swirl is converted into the heat energy. A part of the air that is converted into heat energy is discharged from the hot air discharge outlet 105, and the rest of the hot air produces a backflow due to the pressure difference between the hot air and the low pressure section of the middle of the pipe. The cold air produced by the backflow air at this section and the internal side of the swirl is ejected from the cold air outlet 102 in the direction from B to A. Further, the flow and internal pressure of the super low temperature air gun 100 can be controlled, such that the temperature of the ejected cold air can be controlled. In this preferred embodiment, the internal pressure of the super low temperature air gun 100 is controlled within the range of 6.2~7 kg/cm$^2$, and the flow is controlled within the range of 80~90 nl/min, such that the temperature of the cold air ejected from the cold air outlet 102 can reach −5° C.~−10° C. Since the temperature of the cold air ejected from the super low temperature air gun 100 of the present invention can reach −5° C.~−10° C., the temperature of the cylinder base 11 can drop to 50~60° C.

Figure 2A:
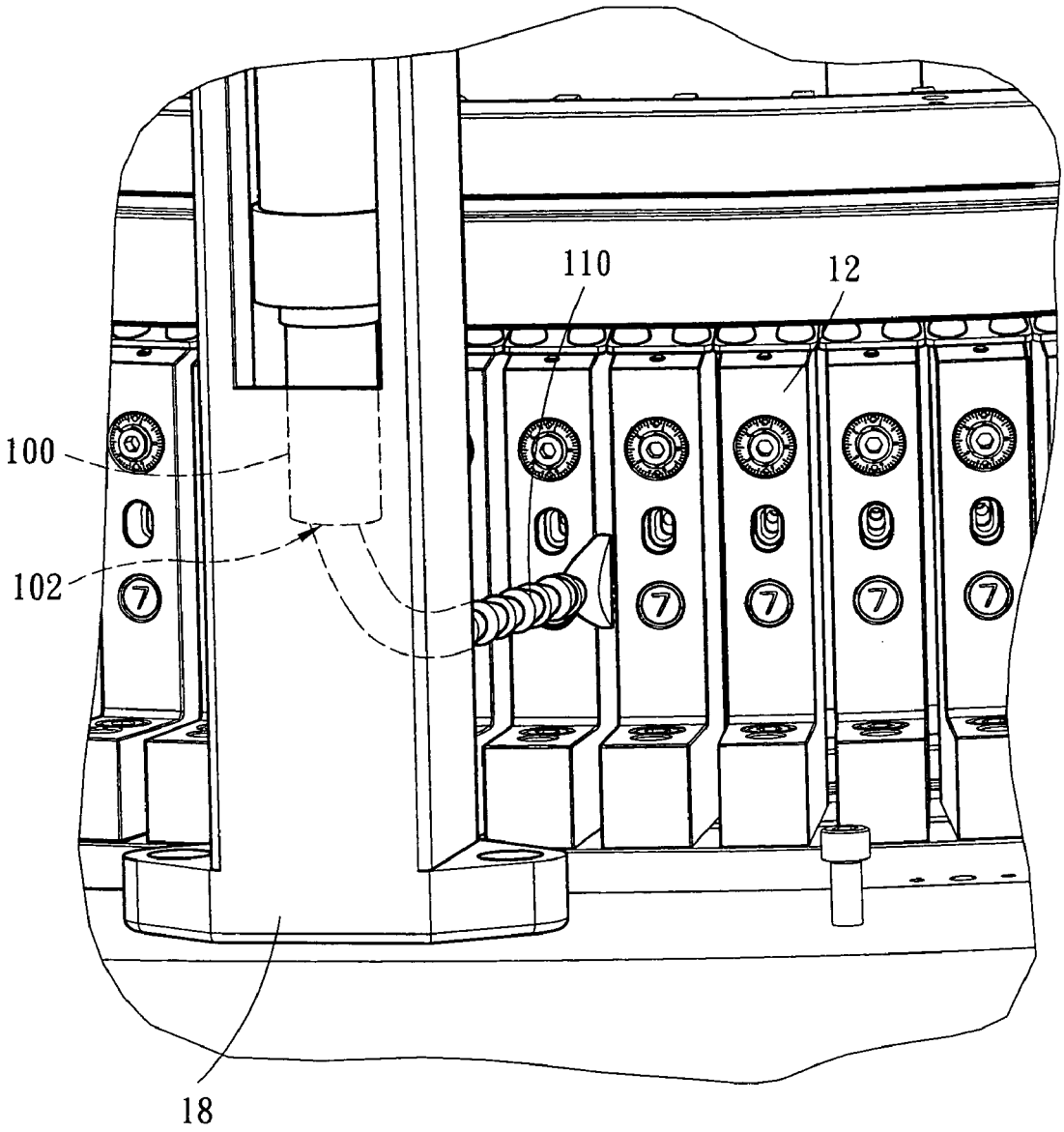
FIGS. 2A and 2B are schematic views of a heat dissipating system of a high-speed circular knitting machine according to a preferred embodiment of the present invention.
Figure 2B:
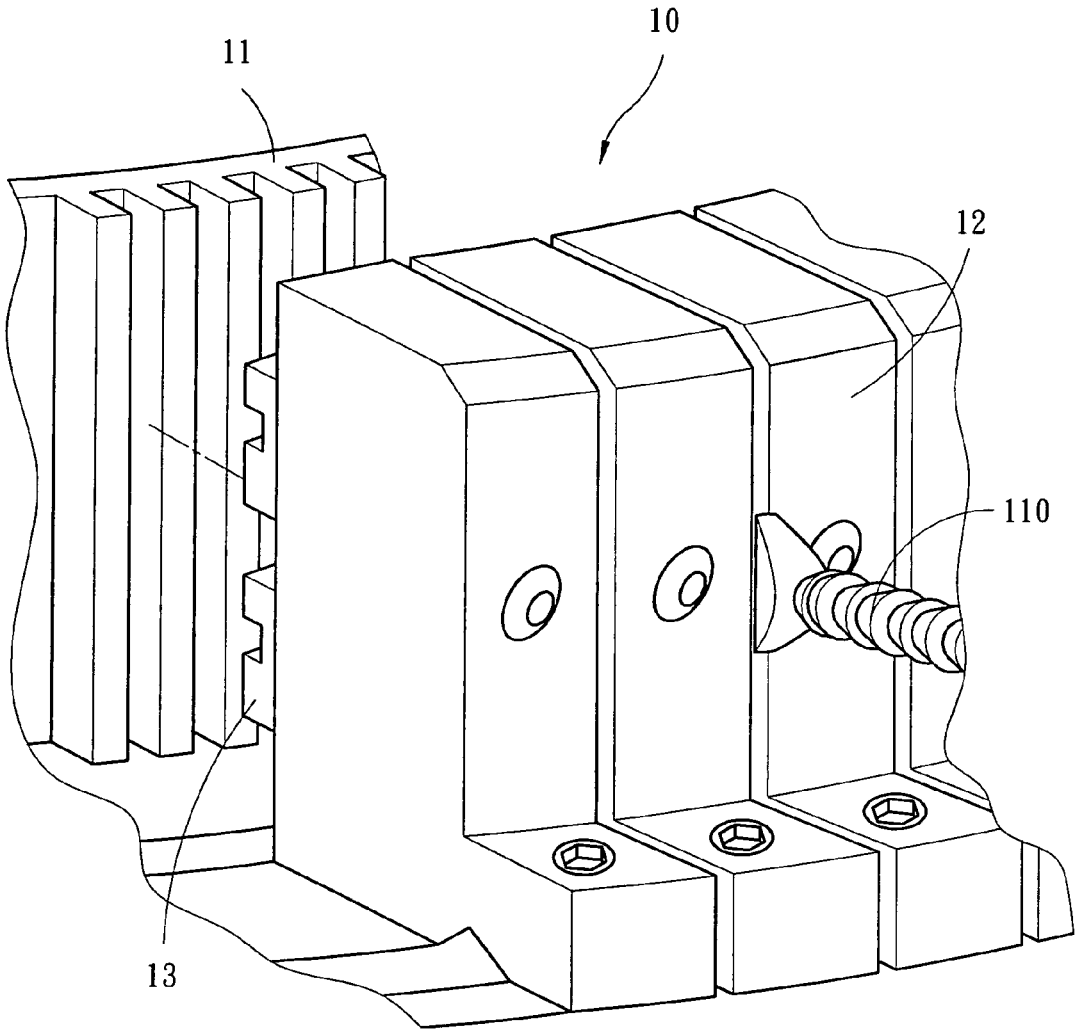

Referring to FIGS. 2A and 2B for the first preferred embodiment of the present invention, the super low temperature air gun 100 is extended to a gap between saddle bases 12 of a high-speed circular knitting machine 10 by an extension pipe 110, and the cold air is ejected from the cold air outlet 102 through the gap to the cylinder base 11 and the cam 13 of the high-speed circular knitting machine 10 to effectively lower the temperature of the high heat on the components.

Figure 3:
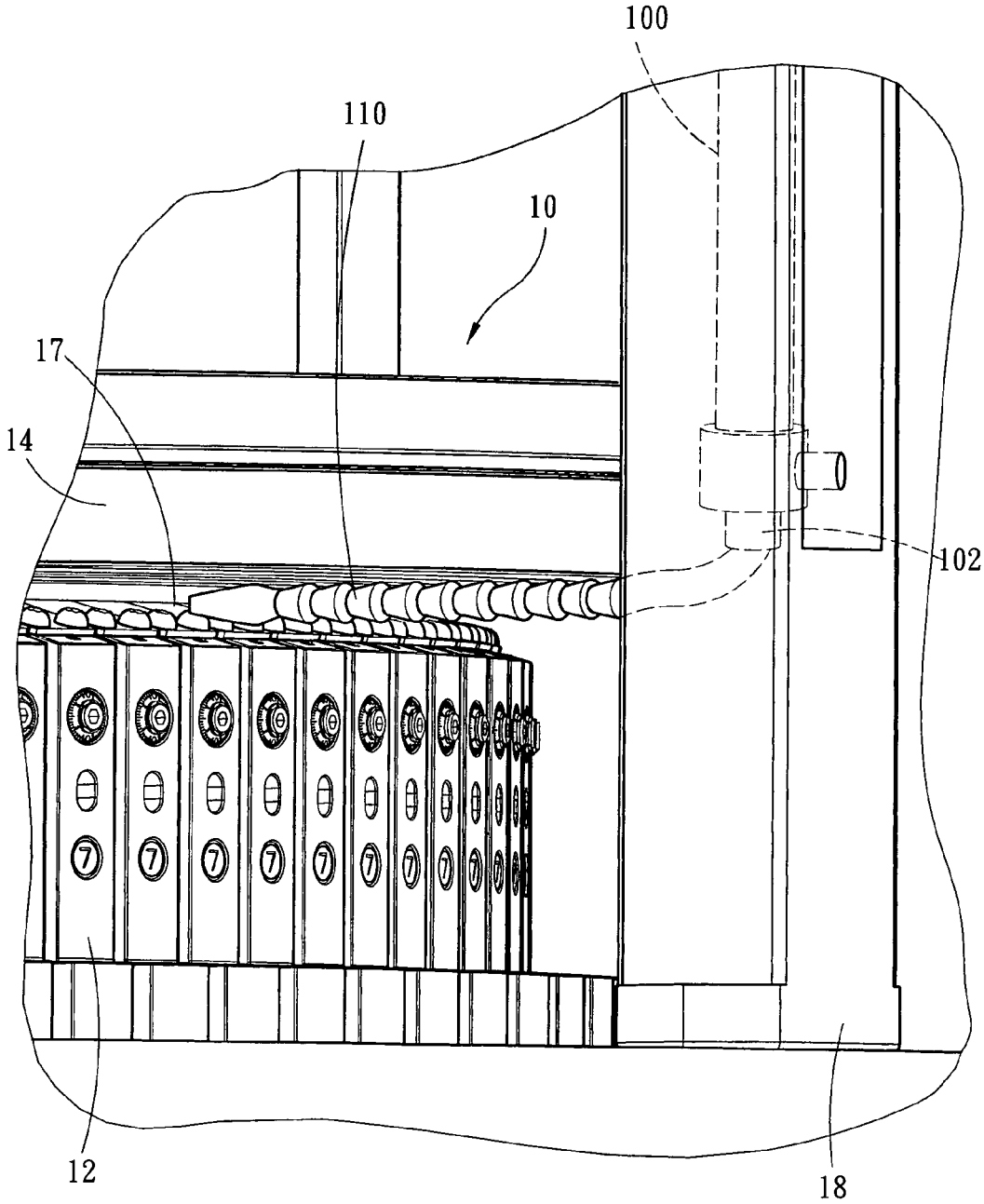
FIG. 3 is a schematic view of a heat dissipating system of a high-speed circular knitting machine according to a second preferred embodiment of the present invention.

Referring to FIG. 3 for the second preferred embodiment of the present invention, the super low temperature air gun 100 is extended to a gap between a cutting disc 14 and a pressing plate 17 of the high-speed circular knitting machine 10 by the foregoing extension pipe 110, and the cold air is ejected from the cold air outlet 102 through the gap and passed through the cylinder base 11 of the high-speed circular knitting machine 10 to effectively lower the high heat of the cylinder base 11.

Figure 4A:
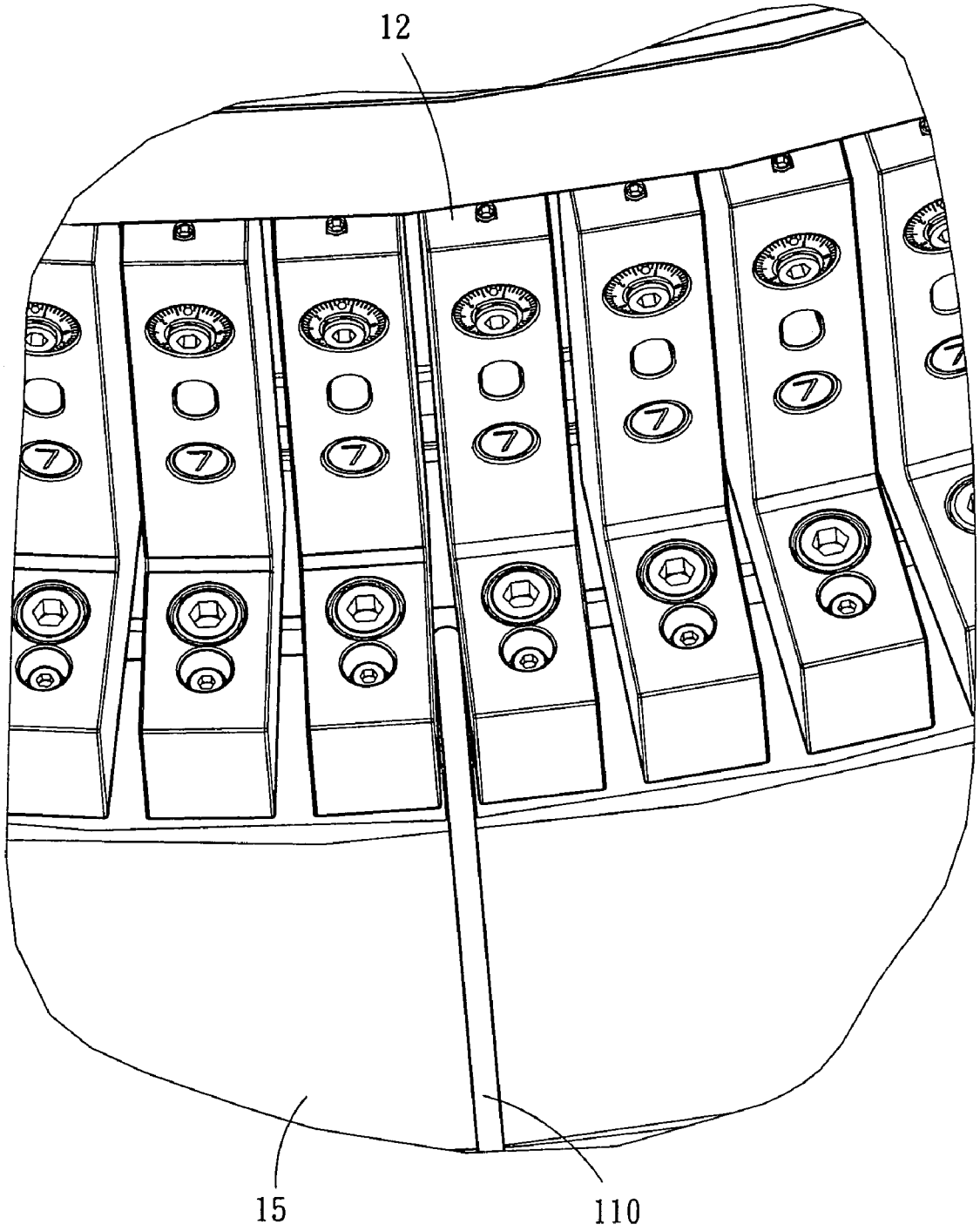
FIGS. 4A and 4B are schematic views of a heat dissipating system of a high-speed circular knitting machine according to a third preferred embodiment of the present invention.
Figure 4B:
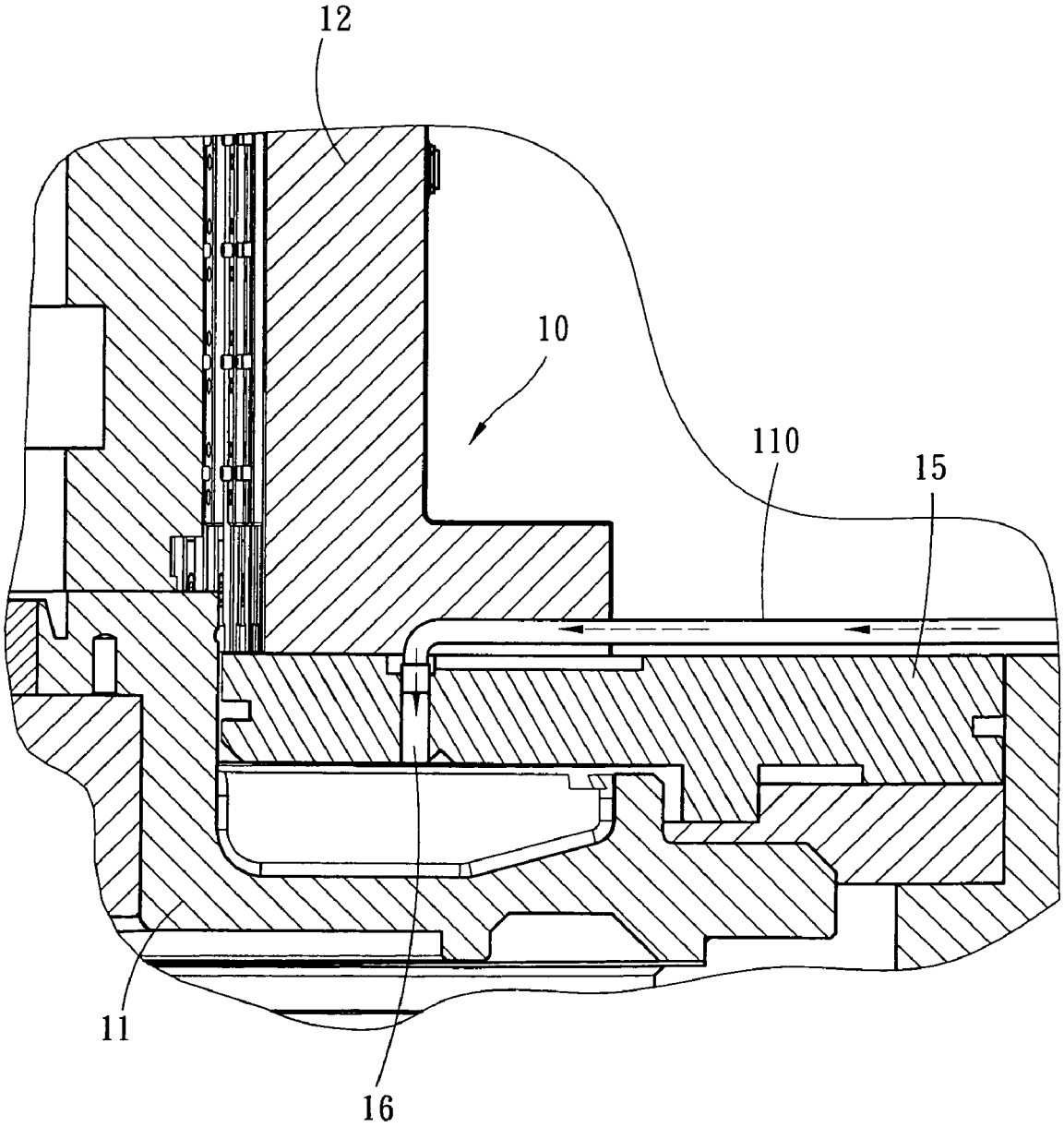

Referring to FIGS. 4A and 4B for the third preferred embodiment of the present invention, the super low temperature air gun 100 is extended to a gap between a lower rhombus ring 15 and two saddle bases 12 of the high-speed circular knitting machine 10 by an extension pipe 110. A penetrating hole 16 is disposed on the lower rhombus ring 15 under the gap, and the extension pipe 110 is connected to the penetrating hole 16. The cold air ejected from the cold air outlet 102 passes through the penetrating hole 16 of the lower rhombus ring 15 to the cylinder base 11 and also passes through the gap between the cylinder base 11 and the lower rhombus ring 15 for effectively lowering the temperature of the high heat on the cylinder base 11.

Figure 5:
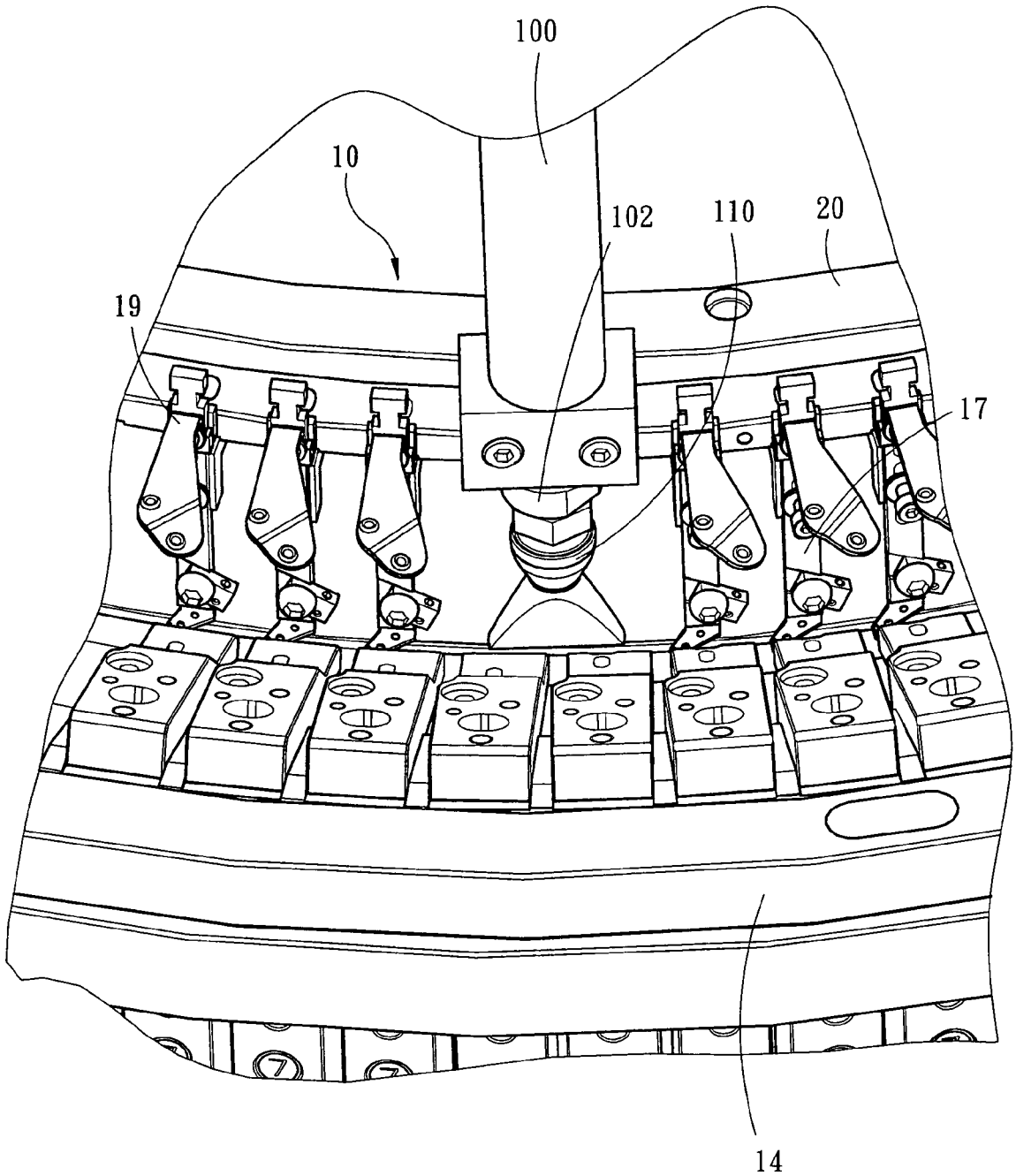
FIG. 5 is a schematic view of a heat dissipating system of a high-speed circular knitting machine according to a fourth preferred embodiment of the present invention.

Referring to FIG. 5 for the fourth preferred embodiment of the present invention, the super low temperature air gun 100 is extended into a gap between yarn feeding nozzles 19 of the high-speed circular knitting machine 10 by the foregoing extension pipe 110, and the cold air is ejected from the cold air outlet 102 to the gap, and then passed through the cylinder base 11 (shown in FIG. 2B), a knitting needle (not shown in the figure) and a sinker (not shown in the figure) of the high-speed circular knitting machine 10 for effectively lowering the temperature of the high heat of the components.

Referring to FIGS. 1 to 5, the super low temperature air gun 100 of the present invention is installed in a leg 18 (which is adopted by the first to third preferred embodiments) for supporting a yarn supplying device (not shown in the figures) in a direction towards the airflow. Furthermore, the super low temperature air gun 100 is installed on the external surface of the leg 18 (particularly on the side proximate to the saddle base 12). The super low temperature air gun 100 may be installed onto a yarn feeding ring 20 (which is adopted by the fourth preferred embodiment). Of course, a person skilled in the art should know that the super low temperature air gun 100 is not limited to be installed to the foregoing leg 18 or yarn feeding ring 20, but it could be installed to any appropriate position of the circular knitting machine 10.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A heat dissipating system of a high-speed circular knitting machine, including a super low temperature air gun and said super low temperature air gun comprising an air inlet, a cold air outlet, a swirl generating chamber, a brake and a hot air discharge outlet; wherein said air inlet, said cold air outlet, and said swirl generating chamber are installed at an end of said super low temperature air gun, and said brake and said hot air discharge outlet are installed at another end of said super low temperature air gun, and compressed air entering into said air inlet is cooled rapidly by said super low temperature air gun and ejected from said cold air outlet; characterized in that said super low temperature air gun is installed on said high-speed circular knitting machine, and the cold air ejected from said cold air outlet of said super low temperature air gun passes through a gap between said cylinder base and its peripheral components for effectively lower the temperature of the high heat produced by high-speed rotations of said cylinder base in a knitting process.

2. The heat dissipating system of a high-speed circular knitting machine of claim 1, wherein said super low temperature air gun is extended into a gap between a cutting disc and a pressing plate of said high-speed circular knitting machine by an extension pipe, and the cold air ejected from said cold air outlet of said super low temperature air gun passes through said gap to said cylinder base of said high-speed circular knitting machine.

3. The heat dissipating system of a high-speed circular knitting machine of claim 1, wherein said super low temperature air gun is extended into a gap between saddle bases of said high-speed circular knitting machine by said extension pipe, and cold air ejected from said cold air outlet of said super low temperature air gun passes through said gap to said cylinder base and said cam of said high-speed circular knitting machine.

4. The heat dissipating system of a high-speed circular knitting machine of claim 1, wherein said super low temperature air gun is extended by a gap between said lower rhombus ring and said two saddle bases of said high-speed circular knitting machine by said extension pipe, a penetrating hole is disposed on said lower rhombus ring under said gap, and said extension pipe is coupled to said penetrating hole, and cold air ejected from said cold air outlet of said super low temperature air gun passes through said penetrating hole of said lower rhombus ring to said cylinder base and said lower rhombus ring of said high-speed circular knitting machine.

5. The heat dissipating system of a high-speed circular knitting machine of claim 1, wherein said super low temperature air gun is extended to a gap between yarn feeding nozzles of said high-speed circular knitting machine by said extension pipe, and cold air ejected from said cold air outlet of said super low temperature air gun passes said gap to said cylinder base, said knitting needle and said sinker of said high-speed circular knitting machine.

6. The heat dissipating system of a high-speed circular knitting machine of claim 1, wherein said super low temperature air gun is installed in a leg for supporting a yarn supplying device.

7. The heat dissipating system of a high-speed circular knitting machine of claim 1, wherein said super low temperature air gun is installed onto a surface of said leg for supporting said yarn supplying device.

8. The heat dissipating system of a high-speed circular knitting machine of claim 1, wherein said super low temperature air gun is installed on a yarn feeding ring.

* * * * *